United States Patent [19]

Wronski

[11] Patent Number: 4,878,699

[45] Date of Patent: Nov. 7, 1989

[54] LATCH MECHANISMS

[75] Inventor: Yurek A. Wronski, Cheltenham, United Kingdom

[73] Assignee: Cotswold Architectural Products Limited, Cheltenham, England

[21] Appl. No.: 184,875

[22] Filed: Apr. 22, 1988

[30] Foreign Application Priority Data

May 2, 1987 [GB] United Kingdom ..... 8710510

[51] Int. Cl.[4] ..... E05C 1/14

[52] U.S. Cl. ..... 292/143; 292/DIG. 33; 49/354; 49/394

[58] Field of Search ..... 292/143, 173, 277, DIG. 21, 292/26, 36, DIG. 33; 49/354, 355, 394

[56] References Cited

U.S. PATENT DOCUMENTS

| | | | |
|---|---|---|---|
| 761,473 | 5/1904 | Goodman | 292/143 |
| 1,041,803 | 10/1912 | Kilburn | 292/36 |
| 1,056,228 | 3/1913 | Stillwell | 292/143 |
| 2,138,933 | 12/1938 | Moseley | 292/143 |
| 2,854,268 | 9/1958 | Graves et al. | 292/143 |
| 3,393,539 | 7/1968 | Gehrie | 292/143 X |
| 4,231,597 | 11/1980 | Pelcin | 292/143 X |

FOREIGN PATENT DOCUMENTS

| | | |
|---|---|---|
| 1185778 | 3/1970 | United Kingdom . |
| 1586047 | 3/1981 | United Kingdom . |
| 2116246 | 9/1983 | United Kingdom . |
| 2164382 | 3/1986 | United Kingdom . |
| 2185521 | 7/1987 | United Kingdom . |

*Primary Examiner*—Richard E. Moore

*Attorney, Agent, or Firm*—Young & Thompson

[57] ABSTRACT

A latch element 13 is mounted on sash 12 on a window and comprises an elongate block having a wedge shape nose 15 and the other part of the latch mechanism 16 comprises a latch member 17 which can be moved rectilinearly by operating handle 19 mounted on the outside of the frame 10 and which has a tongue 20 to engage member 17. The wedge shape nose 21 engages the nose 15 in the locking position.

8 Claims, 2 Drawing Sheets

LATCH MECHANISMS

Figure 1:
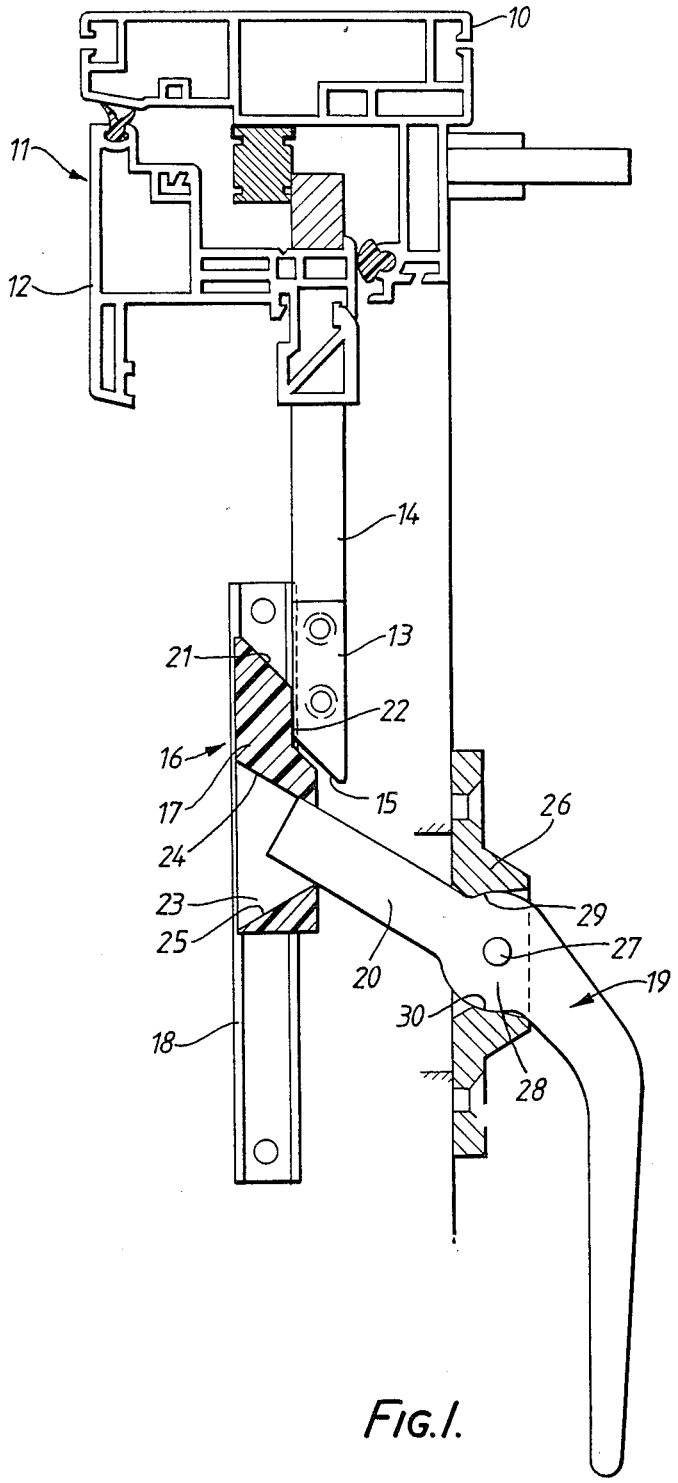

This invention relates to latch mechanisms for windows or the like and in particular, but not exclusively, to latch mechanisms for use with windows having fly screens.

In the United States, and many other countries, a vast number of windows are provided with fly screens which prevent direct access to the window itself from the inside of the house and so the windows are opened and shut remotely by a crank-operated screw mechanism. For many reasons it is found that these mechanisms cannot achieve final closing of the window and so latch mechanisms are provided. In general these consist of hooks pivotally mounted within the window frame so that they can be operated from inside the house to lift and move rearwardly to engage hooks on the window itself and pull the window into its frame. The available space means that the hooks can only engage a window within a very small distance of the frame (say 2 or 3 mm) and the nature of the force imposed on the window hooks by the frame hooks means that they rapidly become damaged or broken.

The present invention consists in a latch mechanism for a window or the like comprising a remotely operable latch member mountable on the window frame for relative movement thereto and a latch element mountable on the window to align with the latch mamber when the window is substantially closed, the facing ends of the member and the element being mutually configured such that when they engage through operative movement of the latch member, the element is drawn across the member into a locked position.

In a preferred embodiment the mechanism further comprises a guide for retaining the member on the window frame for rectilinear movement relative to the frame. The facing end of the member is preferably wedge shaped and in this case the end of the element may also be wedge shaped in an opposite sense to the end of the member. The end of the member may be stepped to define the locked position for the element.

The latch mechanism may further comprise an operating handle mountable on the inside of the window frame and having a tongue for extending through a slot in the window frame to engage the member for transmitting operative movement of the handle to the member. The handle may be pivotally mountable on the frame such that rotational movement of the tongue causes rectilinear movement of the member for engaging or releasing the element.

The invention also consists in a latch assembly comprising a plurality of latch mechanisms as claimed in any one of the previous claims and means for ganging the mechanisms together for simultaneously operative movement.

For example, latch mechanisms may be spaced vertically up one side of a tall window and all the mechanisms may be operated by a single handle associated with the lowermost mechanism.

The invention also includes a window assembly including a latch mechanism or assembly as defined above.

Although the invention has been defined above it is to be understood that it includes any inventive combination of the features set out above or in the following description.

Figure 2:
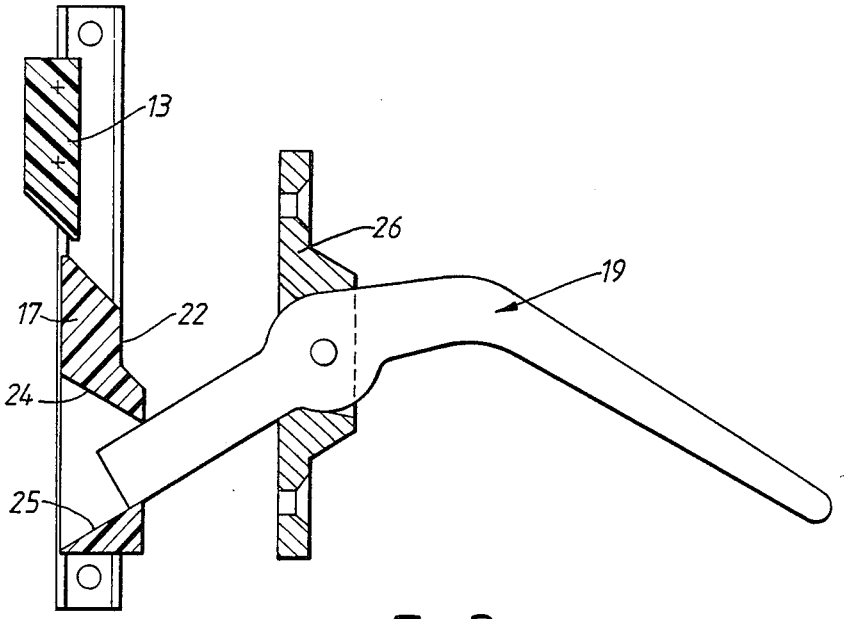

The invention may be performed in various ways and specific embodiments will now be described, by way of example, with reference to the accompanying drawings, in which:

FIG. 1 is a part diagrammatic vertical section through part of a window assembly illustrating the construction of a latch mechanism in its "closed" position; and FIG. 2 is a sectional view of the latch mechanism in FIG. 1 in its "open" position.

FIG. 1 shows a window assembly comprising an outer frame 10 and a window 11 having a sash 12. A latch element 13 is carried on the vertical side member 14 of the sash 12 and comprises an elongate plastics block having a wedge shaped nose 15.

This element 13 forms on part of a latch mechanism, generally indicated at 16. The other part of that mechanism essentially comprises a latch member 17, which is mounted for rectilinear movement of a vertically extending guide 18, and an operating handle 19, which is mounted on the inside of the frame 10, and has a tongue 20, which extends through a slot in the frame 10, to engage the member 17. As can be clearly seen in the drawings, the member 17 consists of a plastics material block having a generally wedge shaped nose 21, which is oppositely sensed to the nose 15 of the element 13 and which is stepped at 22 to define a locked position for the element 13. The main body has a frustotriangular opening 23 for receiving the tongue 20 and defining engagement surfaces 24, 25 for the tongue. The member is further formed, with suitable formations (not shown) for slidingly engaging in the guide 18.

The operating handle 19 is located on the frame 10 by means of a mount 26. As can be seen the handle is pivoted within the mount 26 at 27 and has a generally circular engaged portion 28 surrounding the pivot 27. The periphery of the enlarged portion 28 maintains a continuous seal, during pivoting, with the radiused faces 29, 30 of the mount 26 so that the mount does not allow dust and insects to pass through it.

When the window 11 is open the operating handle 19 and the member 17 are in the position illustrated in FIG. 2. Thus as the window is closed the latch element 13 is brought towards the latch member 17 until their noses 15, 21 overlap. The handle 19 is then swung downwardly into the FIG. 1 position causing the tongue 20 to engage face 24 and lift the member 17 along the guide 18. This movement forces the latch element 13, and hence the window 11 in towards the frame until the latch element drops over the step 22 into the locked position illustrated in FIG. 1. Here it will be seen that the window sash 12 is firmly held against the frame.

The mechanism described above has a number of advantages over existing devices. First the use of a rectilinear movement means that the major part of the width of the nose 21 is available for picking up the latch element 13 and so the room for error in the positioning of the latch element 13 can easily be up to ¾". This is in contrast with the prior art devices, where a lot of the available space is taken up by the need to allow for the rotational movement. Secondly the wedging action used in the device means that the forces are applied steadily and hence there is little or no damage caused to the member 17 or element 11. Thirdly the construction of the handle and mount are such that they form a seal for the slot through which the tongue passes. This is in contrast to existing devices where the affect of the fly screen is considerably reduced by the through passage provided by the slots.

What I claim is:

1. In a window assembly, comprising a frame defining a window opening having an outside and an inside, the window pivotally mounted on the frame for closing the opening by engaging the outside of the frame and a fly screen fixed to the inside of the frame and extending across the opening, a latch mechanism comprising operating means having an operating handle and a tongue movable in response to movement of the handle, means for pivotally mounting the operating means in the window frame such that the operating handle extends inwardly of the frame and the tongue extends outwardly of the frame, a latch member mountable on the outside of the window frame for relative movement thereto and engageable by the tongue for operation by the handle, and a latch element mountable on the window to align with the latch member when the window is substantially closed, the facing ends of the member and element being mutually configured so that when they engage during operational movement of the latch member the element is drawn across the member into a locking position.

2. A latch mechanism as claimed in claim 1, further comprising a guide mountable on the frame for retaining the member on the window frame for rectilinear movement relative to the frame.

3. A latch mechanism as claimed in claim 1, wherein the end of the member is wedge-shaped.

4. A latch mechanism as claimed in claim 3, wherein the end of the element is wedge-shaped in an opposite sense to the end of the member.

5. A latch mechanism as claimed in claim 1, wherein the end of the member is stepped to define a lock position for the element.

6. A latch mechanism as claimed in claim 1, further comprising an operating handle mountable on the inside of the window frame and having a tongue for extending through a slot in the window frame to engage the member for transmitting operative movement of the handle to the member.

7. A latch mechanism as claimed in claim 6, wherein the handle is pivotably mountable on the frame such that rotational movement of the tongue causes rectilinear movement of the member for engaging or releasing the element.

8. In a window assembly, comprising a frame defining a window opening having an outside and an inside, the window pivotally mounted on the frame for closing the opening by engaging the outside of the frame and a fly screen fixed to the inside of the frame and extending across the opening, a latch mechanism comprising operating means having an operating handle and a tongue movable in response to movement of the handle, means for pivotally mounting the operating means in the window frame such that the operating handle extends inwardly of the frame and the tongue extends outwardly of the frame, a latch member mountable on the outside of the window frame for relative movement thereto and engageable by the tongue for operating by the handle, and a latch element mountable on the window to align with the latch member when the window is substantially closed, the facing ends of the member and element being mutually configured so that when the engage during operational movement of the latch member the element is drawn across the member into a locking position, the operating means further including an enlarged portion intermediate the handle and tongue and being located in mounting means, the mounting means and enlarged portion being contoured such that they maintain a seal between the inside and outside of the frame during the pivoting movement of the handle.

* * * * *